United States Patent [19]

Takano

[11] Patent Number: 4,672,352

[45] Date of Patent: Jun. 9, 1987

[54] FUSE ASSEMBLY

[75] Inventor: Tsunesuke Takano, Tokyo, Japan

[73] Assignee: Kabushiki Kaisha T an T, Tokyo, Japan

[21] Appl. No.: 854,898

[22] Filed: Apr. 23, 1986

[51] Int. Cl.[4] ..... H01H 85/22

[52] U.S. Cl. ..... 337/264; 337/260; 337/295

[58] Field of Search ..... 337/251, 255, 264, 295, 337/260

[56] References Cited

U.S. PATENT DOCUMENTS 4,570,147 2/1986 Ebi ..... 337/295

FOREIGN PATENT DOCUMENTS 59-41563 11/1984 Japan .

*Primary Examiner*—Harold Broome

*Attorney, Agent, or Firm*—Cushman, Darby & Cushman

[57] ABSTRACT

A fuse assembly having a casing, a fuse element made of an electrically conductive material having a low fusion point, and tab insertion sockets into which tab terminals are inserted and which are made of a highly resilient, electrically conductive material having a high fusion point, the fuse element and the tab insertion socket being combined with each other in the casing, the fuse element alone being replaced when blown at a relatively low level of heat generation.

3 Claims, 8 Drawing Figures

FUSE ASSEMBLY

BACKGROUND OF THE INVENTION

1. Field of the Invention

The present invention relates to a fuse and more particularly to a fuse assembly of a type having a casing made of insulating material, sockets into which tab terminals are inserted, and a fuse element constituted by a thin metal plate which has a narrower width at its midway portion and which is curved to form a U-shape, thus being attachable to the tab terminals.

2. Description of the Prior Art

Generally, the type of fuse which has been used for automobiles and the like has a narrower width portion and has a gentle characteristic, namely, a slow-blow characteristic, so that it does not cut off an excessive current or a lock current flowing for a short time at a level higher than the steady current value but is safely fused by an excessive current flowing at a level higher than the steady current value for a long time, for example, by a a short-circuit current. Such a slow-blow fuse is disclosed in Japanese Utility Model Publication No. 41563 / 1984, in which tab sockets into which tab terminals are inserted are integrally formed at the opposite ends of a fuse element.

For the purpose of integrally forming the tab terminal sockets at the opposite ends of the fuse element, it is necessary to use an electrically conductive material having a a, for example, copper alloys having high fusion points such as phosphor bronze, etc. If the fuse portion is made of phosphor bronze, it does not fuse when the temperature thereof is under 1000° C., and the resilience of the socket is reduced by heat conduction before the temperature of the fuse portion reaches that level, so that the contact resistance between the socket and a tab terminal is increased and the socket is thereby heated even more. The resilience of the socket is then reduced further, and the heat thereof is again increased. Thus there is a fear of combustion of the casing before the fuse portion is actually blown through such a recurring process. Moreover, it is uneconomical for the entire fuse including its socket terminal portions or the whole of the fuse assembly to have to be replaced when the fuse element is blown.

SUMMARY OF THE INVENTION

1. Object of the Invention

The object of the present invention is to eliminate the above defects and the present invention aims to provide a fuse assembly which has a fuse element made of a non-resilient, electrically conductive material having a low fusion point such as zinc alloy, and a tab insertion socket made of a highly resilient, electrically conductive material having a high fusion point such as phosphor bronze, the fuse element and the tab insertion socket being combined with each other in a casing, the fuse element being fused at a low level of heat generation, thus making it possible for the fuse element alone to be replaced and enabling the resilience of the socket to be maintained.

2. Brief Summary of the Invention

To this end, the present invention provides a fuse assembly comprising: a casing made of insulating material and having a plurality of socket insertion holes communicating with a fuse element insertion hole, a socket retaining protrusion formed on the inner surface of the outside wall of each socket insertion hole, a fuse element retaining protrusion formed on a partitioning portion between the socket insertion holes, and rectangular tab terminal insertion holes formed at the outside end of the socket insertion hole; a tab insertion socket inserted in the socket insertion hole and constituted by a resilient, electrically conductive plate whose opposite ends are curved toward its one side and which has retaining protrusion formed on the other side; a U-shaped fuse element constituted by a metal plate having a low fusing temperature, the metal plate forming a fuse portion at its middle portion which is narrower in width than the end portions on each side thereof, the metal plate forming connecting terminal portions having retaining protrusions and inserted through the element insertion hole into the socket which is inserted into the socket insertion hole formed in the casing; and a cover attached to one side of the casing on which the fuse element insertion hole is formed.

BRIEF DESCRIPTION OF THE DRAWINGS

FIG. 5 (*b*) is a transverse sectional view taken along a line A—A of FIG. 5 (*a*);

FIG. 6 (*b*) is a bottom view of the fuse assembly in which a part of the tab terminal is cut off.

DESCRIPTION OF THE PREFERRED EMBODIMENT

Figure 1:
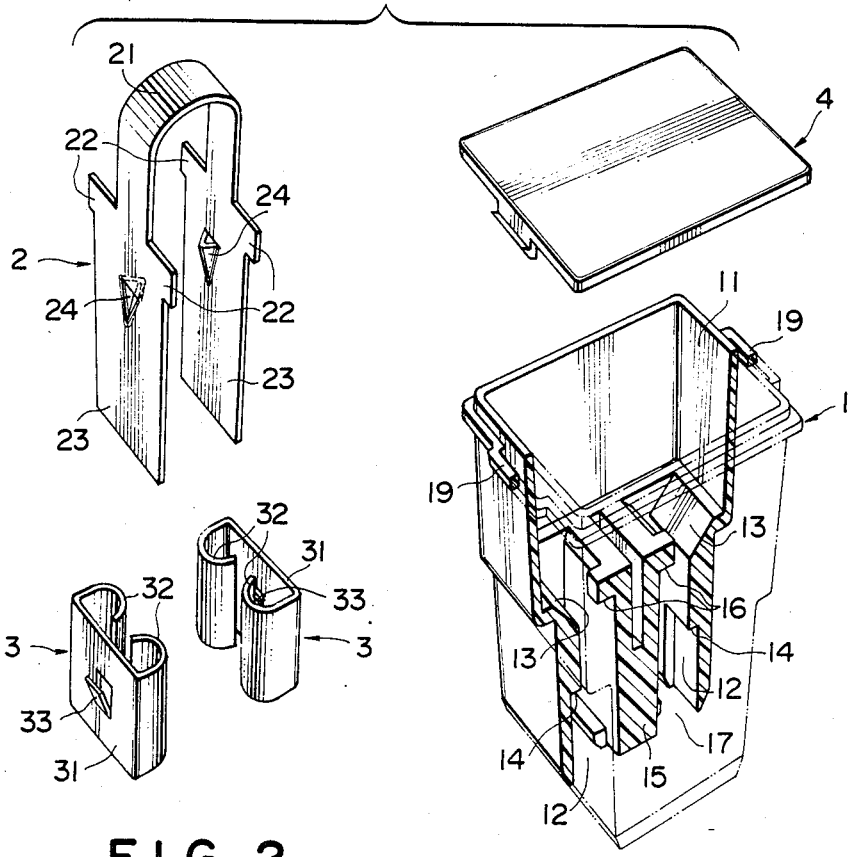
FIG. 1 is a perspective view showing components of a fuse assembly whose casing is partially cut off.

FIG. 1 shows a fuse assembly according to the present invention which is composed of a casing 1, fuse element 2, two tab insertion sockets 3 and a cover 4.

Figure 2:
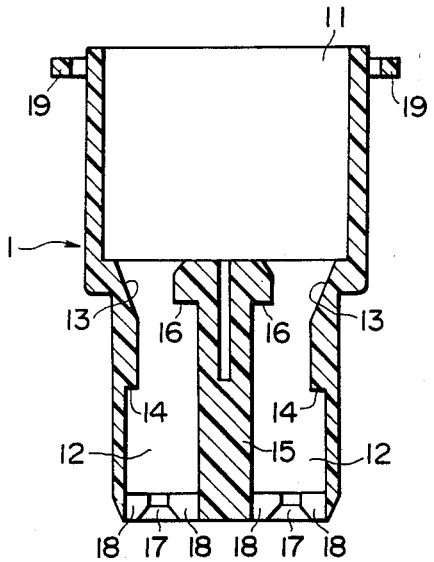
FIG. 2 is a longitudinal sectional view of the casing.

As shown in FIGS. 1 and 2, the casing 1 is molded by using a castable plastic resin. The casing 1 has a fuse element insertion hole 11 which is formed at one end of the casing 1, and whose depth is substantially one half of the length of the casing 1 and whose opening is in the form of a large rectangle. The casing 1 also has two socket insertion holes 12 communicated with the fuse element insertion hole 11. A slanted surface 13 and a socket retaining protrusion 14 are formed on the inner surface of each outside wall of the socket insertion holes 12, and fuse element retaining protrusions 16 are formed on a partitioning portion 15 which is located between both socket insertion holes. Socket retaining flanges 18 forming a rectangular tab terminal insertion hole 17 are formed at the open end of the socket insertion hole 12, that is, at the other end of the casing 1 relative to the fuse element insertion hole 11. Two cover attachment rings 19 are formed on the external surfaces of the casing 1 at the end thereof. They are alinged in the longitudinal direction of the open end configuration of the fuse element insertion hole.

Figure 3:
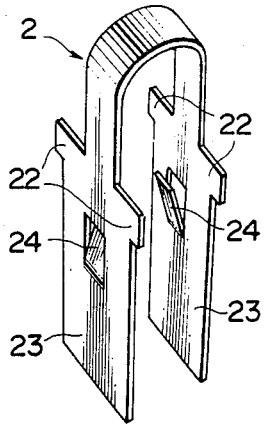
FIG. 3 is a perspective view of another embodiment of a fuse element.

The fuse element 2 is constituted by a thin strip plate made of a zinc alloy of low fusing temperature, that is, having a fusion point of 450° C. As shown in FIG. 1, the middle portion of the plate which covers one half of the whole length of the plate is formed such as to have a narrow width, and a pair of flat connection terminal portions 23 having side projections 22 are formed in the strip plate. A retaining protrusion 24 in the form of a trigonal pyramid or a detent cut and bent as shown in FIG. 3 is formed in each flat connection terminal portion 23. The strip plate is curved so that it assumes the form of a U and each retaining protrusion 24 projects inwardly. The connection terminal portions 23 are disposed parallel with each other and spaced apart by the distance defined between the outer surfaces of the protrusions 16.

The tab insertion socket 3 is constituted by a rectangular plate made of a resilient metal having a high electrical conductivity, for example, phosphor bronze. The opposite ends of the rectangular plate are curved toward one surface of a flat portion 31 located at the middle of the plate so that the end surfaces of the plate are opposed to this surface, thus forming a pair of resilient engaging portions 32. The flat portion has a retaining protrusion 33 in the form of a detent which is cut and bent at the middle of the flat portion so as to protrude at the side of the other surface thereof.

The cover 4 is molded by using a castable plastic resin and it has a rectangular covering plate portion 41 for covering the fuse element insertion hole 11 of the casing 1, and a pair of engaging hooks 42 which are formed at both ends of the cover corresponding to the longitudinal axis thereof and which are inserted into and engage with the cover attachment rings 19.

The fuse assembly according to the present invention has these components and is assembled in the manner described below.

Figure 4:
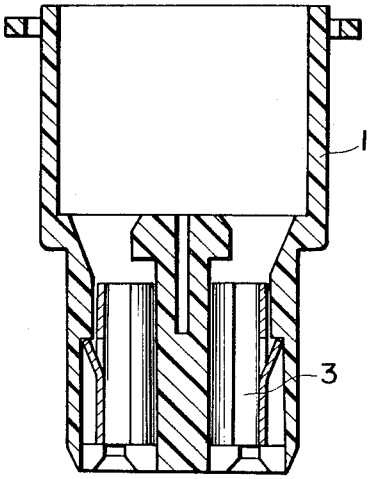
FIG. 4 is a sectional view of the casing into which a tab insertion socket is inserted.

As shown in FIGS. 2 and 4, the tab insertion socket 3 is inserted through the fuse element insertion hole 11 of the casing 1 into the socket insertion hole 12 with the assistance of the slanted surface 13, while the side of the socket 3 on which the resilient engaging portions 32 are formed is opposed to the partitioning portion 15. When the tab insertion socket is set, its one end contacts the socket retaining flanges 18 and the retaining protrusion 33 engages with the socket retaining protrusion 14.

Figure 5A:
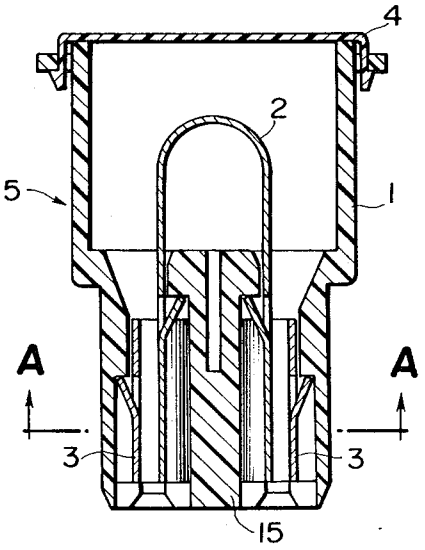
FIG. 5 (*a*) is a longitudinal sectional view of the completed fuse assembly.
Figure 5B:
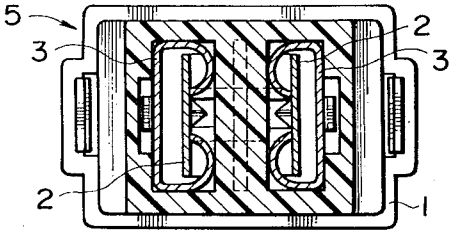

Next, as shown in FIGS. 5 (*a*) and (*b*), the fuse element 2 is inserted into the fuse element insertion hole 11 of the casing 1 so that its connection terminal portion 23 is inserted between the flat portion 31 and the resilient engaging portions 32 of the tab insertion socket 3 in the socket insertion hole 12, thus making electrical connection with the resilient engaging portions 32. In this state, the top of the connection terminal portion contacts the socket retaining flanges 18, and the retaining protrusion 24 engages with the fuse element retaining protrusion 16.

In this way, the casing 1, tab insertion socket 3 and the fuse element 2 are integrally combined with each other.

The cover 4 is thereafter integrally attached to the casing 1, as shown in FIG. 5 (*a*), the engaging hook 42 being inserted into the cover attachment ring 19, thus forming the fuse assembly 5.

Figure 6A:
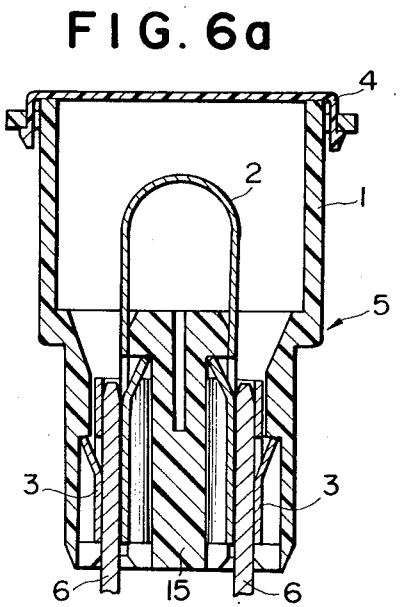
FIG. 6 (*a*) is a longitudinal sectional view of the fuse assembly which is attached to tab terminals.
Figure 6B:
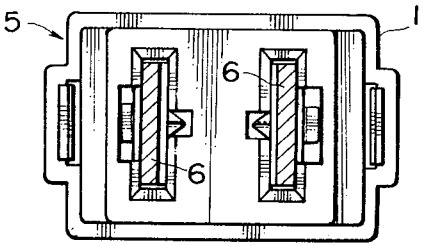

The fuse assembly 5 is attached to a pair of tab terminals 6 disposed in a fuse box (not shown), as shown in FIG. 6 (*a*) and (*b*). Each of the tab terminals 6 is inserted into the casing 1 through the tab terminal insertion hole 17 and is set between the flat portion 31 of the socket 3 and the connection terminal portion 23 of the fuse element 2 which has been previously set. The fuse element 2 thus interconnects the pair of tab terminals.

When a current flows through the fuse element 2 at a level above a steady current value and the fuse is blown, it is possible to regenerate the fuse assembly by replacing the blown fuse element with a new fuse element. That is, the fuse assembly is pulled out from the tab terminals 6 by seizing the casing 1, and the cover 4 is opened. Then the blown fuse element is removed by using a tool such as a screw driver and is replaced with the new fuse element.

ADVANTAGES OF THE INVENTION

As described herein, the fuse assembly according to the present invention is provided with: the casing made of insulating material and having the socket insertion holes communicating with the fuse element insertion hole, the socket retaining protrusion formed on the inner surface of the outside wall of the socket insertion hole, the fuse element retaining protrusion formed on the partitioning portion between the socket insertion holes, and the rectangular tab terminal insertion holes formed at the outside end of the socket insertion hole; the tab insertion socket inserted in the socket insertion hole and constituted by a resilient, electrically conductive plate whose opposite ends are curved toward its one side and which has retaining protrusion formed on the other side; the U-shaped fuse element constituted by a metal plate having a low fusing temperature, the metal plate forming a fuse portion at its middle portion which is narrower in width than the end portions on each side thereof, and the metal plate forming the connecting terminal portions having retaining protrusions and inserted through the element insertion hole into the socket which is inserted into the socket insertion hole formed in the casing; and the cover attached to one side of the casing on which the fuse element insertion hole is formed. According to this arrangement, the fusion point of the fuse portion is low so that there is no risk of damage by a fire due to the reduction in the resilience of the socket and the heat generation at the casing. Moreover, the fuse assembly can be regenerated by replacing only the blowed fuse element, and the fuse element and the socket are readily made since they are separated, thus saving the cost in terms of resources and production.

What is claimed is:

1. A fuse assembly comprising:

a casing made of insulating material and having a plurality of socket insertion holes communicating with a fuse element insertion hole, a socket retaining protrusion formed on the inner surface of the outside wall of each of said socket insertion holes, a fuse element retaining protrusion formed on a partition wall located between said socket insertion holes, and a rectangular tab terminal insertion hole formed at the outside end of said socket insertion hole;

a tab insertion socket inserted in each of said socket insertion holes and constituted by a resilient, electrically conductive plate whose opposite ends are curved toward its one side and which has retaining protrusion formed on the other side, said plate having a high fusing temperature;

a U-shaped fuse element constituted by a metal plate having a low fusing temperature, said metal plate forming a fuse portion at its middle portion which is narrower in width than the end portions on each side of said metal plate, said metal plate forming connecting terminal portions having retaining protrusions and inserted through said fuse element insertion hole into said tab insertion socket which is inserted into said socket insertion hole formed in said casing; and a cover attached to one side of said casing on which said fuse element insertion hole is formed.

2. The fuse assembly of claim 1, wherein:

said plate of each said tab insertion socket has a fusing temperature which is about 500° C. above that of said metal plate of said U-shaped fuse element.

3. The fuse assembly of claim 2, wherein:

said plate of each said tab insertion socket is made of phosphor bronze and said metal plate of said U-shaped fuse element is made of a zinc alloy.

* * * * *